US011952845B2

(12) United States Patent
Lu et al.

(10) Patent No.: US 11,952,845 B2
(45) Date of Patent: Apr. 9, 2024

(54) MANAGING GAS BUBBLE MIGRATION IN A DOWNHOLE LIQUID

(71) Applicant: Landmark Graphics Corporation, Houston, TX (US)

(72) Inventors: Jianxin Lu, Bellaire, TX (US); Michael T. Pelletier, Houston, TX (US); Dale E. Jamison, Humble, TX (US); Arash Haghshenas, Spring, TX (US); Li Gao, Katy, TX (US)

(73) Assignee: Landmark Graphics Corporation, Houston, TX (US)

( * ) Notice: Subject to any disclaimer, the term of this patent is extended or adjusted under 35 U.S.C. 154(b) by 539 days.

(21) Appl. No.: 17/274,256

(22) PCT Filed: Jun. 4, 2019

(86) PCT No.: PCT/US2019/035396

§ 371 (c)(1),
(2) Date: Mar. 8, 2021

(87) PCT Pub. No.: WO2020/139415

PCT Pub. Date: Jul. 2, 2020

(65) Prior Publication Data

US 2021/0355771 A1 Nov. 18, 2021

Related U.S. Application Data

(60) Provisional application No. 62/785,935, filed on Dec. 28, 2018.

(51) Int. Cl.
*E21B 21/08* (2006.01)
*E21B 44/00* (2006.01)

(52) U.S. Cl.
CPC ..... *E21B 21/08* (2013.01); *E21B 44/00* (2013.01); *E21B 2200/20* (2020.05)

(58) Field of Classification Search
None
See application file for complete search history.

(56) References Cited

U.S. PATENT DOCUMENTS

2002/0029883 A1 3/2002 Vinegar et al.
2009/0173150 A1 7/2009 DiFoggio et al.
(Continued)

FOREIGN PATENT DOCUMENTS

WO 2016040310 3/2016

OTHER PUBLICATIONS

E-Drilling, "e-Drilling Launches WellPlanner Microservices", Dec. 17, 2020, 3 pages.
(Continued)

*Primary Examiner* — Daniel S Larkin
(74) *Attorney, Agent, or Firm* — Kilpatrick Townsend & Stockton LLP

(57) ABSTRACT

Gas bubble migration can be managed in liquids. In one example, a system can execute wellbore-simulation software to simulate changes in gas dissolution in a liquid over time. This may involve dividing the wellbore into segments spanning from the well surface to the downhole location, each segment spanning a respective depth increment between the well surface and the downhole location. Next, for each time, the system can determine a respective multiphase-flow regime associated with each segment of the plurality of segments based on a simulated pressure level, a simulated temperature, a simulated pipe eccentricity, and a simulated fluid velocity at the segment. The system can also determine how much of the gas is dissolved in the liquid at each segment based on the respective multiphase-flow regime at the segment. The system can display a graphical user interface representing the gas dissolution in the liquid over time.

20 Claims, 7 Drawing Sheets

(56) References Cited

U.S. PATENT DOCUMENTS

| | | | | |
|---|---|---|---|---|
| 2016/0098502 | A1* | 4/2016 | Havre | G06F 30/20 703/9 |
| 2016/0177708 | A1 | 6/2016 | Stokely | |
| 2017/0038491 | A1 | 2/2017 | Gonzalez et al. | |
| 2020/0190950 | A1* | 6/2020 | Bailey | E21B 41/00 |

OTHER PUBLICATIONS

Halliburton, "Baroid Drilling Fluids Graphics Software and LCM Strategy Help Provide Successful Drilling Operations and Cement Job", 3 pages, 2016.
Intellicess , SentinelRT, 5 pages, 2016.
Landmark, "Real-Time Well Engineering", 2020, 2 pages.
Landmark, "Well Plan Software", 2016, 4 pages.
Monteiro et al., "Study of the PVT Properties of Gas-Synthetic Drilling Fluid Mixtures Applied to Well Control", SPE Drilling Engineering, pp. 45-52, Mar. 2010.
Nabors, "Navigator Software Platform", Mar. 12, 2018, 3 pages.
Nakanoh et al., "Gas Absorption by Newtonian and Non-Newtonian Liquids in a Bubble Column", Ind. Eng. Chem. Process Des. Dev. 1980, pp. 190-195.
O'Bryan et al., "An Experimental Study of Gas Solubility in Oil-Based Drilling Fluids", SPE Drilling Engineering, pp. 33-42, Mar. 1988.
O'Bryan et al., "Swelling of Oil-Based Drilling Fluids Resulting from Dissolved Gas", SPE Drilling Engineering, pp. 149-155, Jun. 1990.
International Application No. PCT/US2019/035396, International Search Report and Written Opinion, dated Sep. 25, 2019, 12 pages.
Schlumberger, "Drillbench Dynamic Hydraulics", 2016, 1 page.
Sperry, "Drilling Engineering Solutions", 12 pages.
Sun et al., "A New Model for Hydrodynamics and Mass Transfer of Hydrated Bubble Rising in Deep Water", Chemical Engineering Science 173 pp. 168-178, 2017.
Van Slyke et al., "Predicting Gas Kick Behavior in Oil-Based Drilling Fluids Using a PCT-Based Dynamic Wellbore Modle", SPE Drilling Engineering, pp. 505-514, 1990.

* cited by examiner

MANAGING GAS BUBBLE MIGRATION IN A DOWNHOLE LIQUID

REFERENCE TO RELATED APPLICATION

This application claims priority to U.S. Provisional Patent Application No. 62/785,935, entitled "Determining Gas Bubble Migration in Drilling Fluid," filed Dec. 28, 2018, the entirety of which is hereby incorporated by reference herein.

TECHNICAL FIELD

The present disclosure relates generally to wellbore systems and operations. More specifically, but not by way of limitation, this disclosure relates to managing gas bubble migration in a downhole liquid.

BACKGROUND

A well system can include a wellbore drilled through a subterranean formation for extracting hydrocarbons from a reservoir. Hydrocarbon production from the wellbore can be dangerous due to changing densities, boiling points, and freezing points of the hydrocarbons as the molecular weight of the hydrocarbons changes, which can lead to blowouts and other failures. Determining how to optimally and safely produce the hydrocarbons from the reservoir can be challenging for other reasons, too, such as unknown or changing environmental conditions within the wellbore.

DETAILED DESCRIPTION

Figure 1:
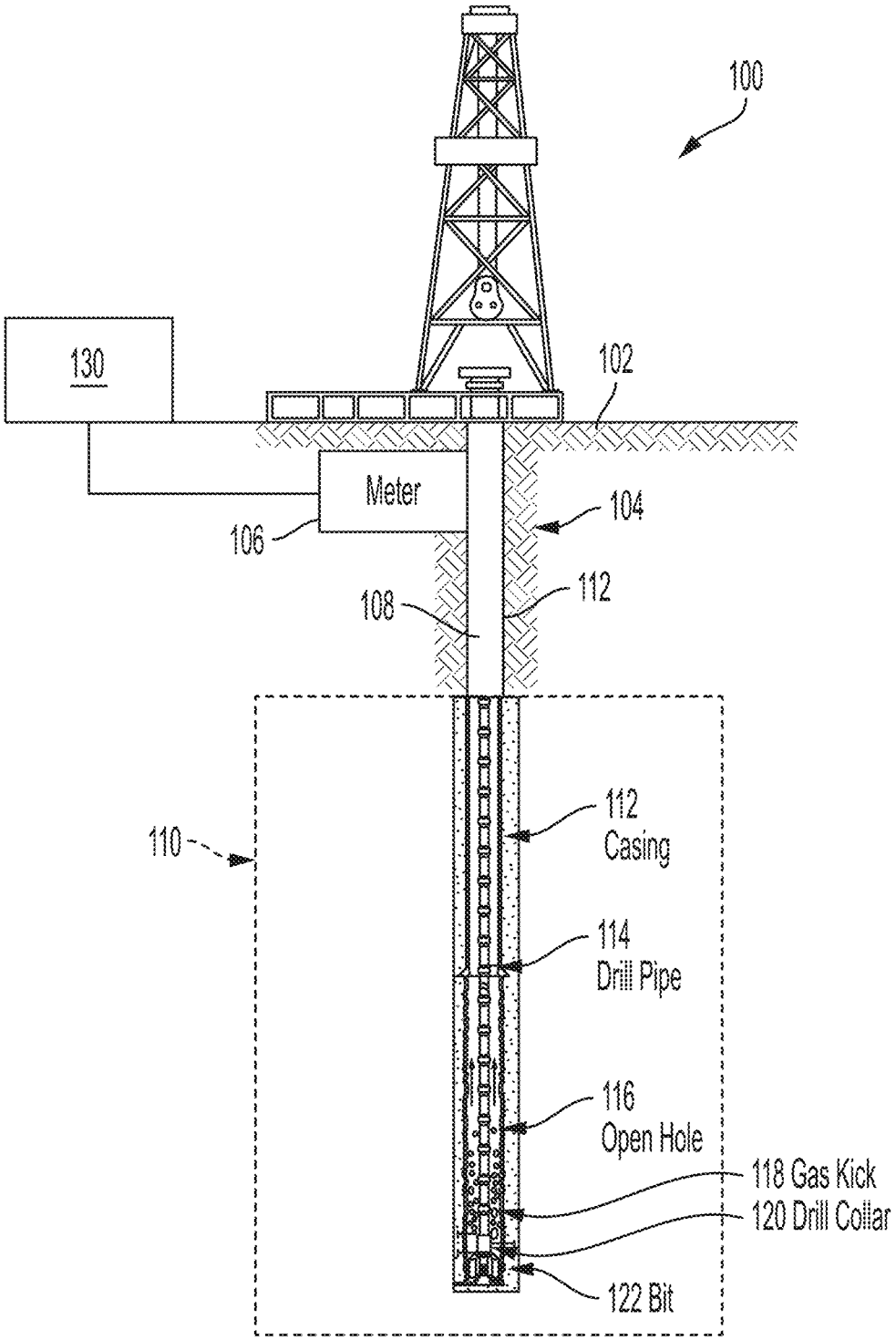
FIG. 1 is a cross-sectional view of an example of a well system according to some aspects of the present disclosure.

Certain aspects and features of the present disclosure relate to simulating changes in how a gas is dissolved within a liquid (e.g., a drilling fluid or drilling mud) flowing from a downhole location to a well surface through a wellbore. The simulation can take place over the course of multiple time steps and account for various downhole conditions (e.g., temperature and pressure) that influence gas dissolution changes in the liquid as the liquid flows uphole. The resulting simulation can enable well operators to better manage wellbore operations and drilling operations, thereby reducing cost, non-productive time, and operational risk.

More specifically, some examples of the present disclosure can involve wellbore-simulation software capable of determining gas bubble migration in a liquid and account for non-equilibrium dissolution and separation effects due to changes in downhole temperatures and pressures. This can result in a more accurate simulation of gas bubble migration through the wellbore, which can be applied to form a better plan for well control, underbalanced drilling, and managed pressure drilling (MPD).

In one specific example, a circulation process may be implemented in a wellbore by circulating drilling mud throughout the wellbore, beginning at one point in the wellbore and eventually returning to the same point. As the drilling mud is circulated through the wellbore, gas bubbles may enter the wellbore from a downhole gas reservoir or another source. Some of the gas bubbles may partially dissolve into the drilling mud and the others may remain in a free gas phase for a period of time until being fully dissolved. And the amount of gas dissolved in the drilling mud can change over time during the circulation process due to changes in temperature and pressure in the wellbore at different locations. These changes can lead to a variety of dangerous conditions, if they are not properly accounted for.

Traditional simulation software may rely on pressure-volume-temperature (PVT) calculations that assume that the gas and drilling mud will reach an equilibrium state (e.g., in which the amount of gas dissolved in the drilling mud will not tend to change unless acted upon) nearly-instantaneously, throughout the wellbore. But this yields inaccurate results, because, in actuality, dissolved gases traveling uphole begin to separate from the liquid phase due to changes in temperature and pressure. This separation is also driven by gas dynamics, resulting in some gases taking a longer amount of time to separate. Traditional simulation software employ equations of state (e.g., the Soave-Redlich-Kwong equation of state) that fail to account for these phenomena because these simulations often perform a single, instantaneous calculation that is based on the assumption that an equilibrium state will be reached. Consequently, traditional simulation software predicts a much higher level of gas solubility (the maximum amount of gas that will dissolve in a specific amount of drilling mud, at a specific temperature, with a specific amount of pressure) than is actually present. Additionally, traditional simulation software also under-estimates free gas volume (e.g., the amount of space occupied by undissolved gas present in the wellbore) and surface pit-gain (e.g., the amount of mud displaced at the surface based on the volume of drilling mud entering the wellbore), which can both be critical to well planning, real-time operations, and event detection.

As a specific example, during drilling processes (e.g., tripping pipe, surge processes, or swab processes), gas bubbles may form and enter into the wellbore. When gas bubbles first enter an open hole in the wellbore, some gas bubbles will be partially dissolved into the drilling mud, but some other gas bubbles will remain in a free gas phase, for a migration distance, until being fully dissolved. A PVT calculation may be utilized to determine gas solubility for a given area within the wellbore. However, when a PVT calculation is performed solely based on an equilibrium state, the result may give an inaccurate prediction, including a much higher gas solubility or a prediction that all gases are dissolved into the drilling mud. Such an under-estimation of free gas volume and surface pit-gain may lead to well blowouts because as gases travel closer to the surface, with reduced pressure and temperature, the dissolved gases may separate from the liquid phase.

Some examples of the present disclosure can overcome one or more of the above issues by including gas dissolution and separation rate into the simulation of the dynamic process of gas migration, resulting in a more accurate estimation. The simulation can also be applied to determine the bottomhole pressure (e.g., the pressure at the deepest part of the well) with increased accuracy to mitigate potential problems and reduce non-productive time. The simulation can be applied in a variety of contexts, such as during MPD, under-balanced drilling, well control, tripping drill pipes, and drilling automation for more accurate determination of multiphase gas-liquid mixture. In some examples, the determination can include a non-equilibrium state calculation of gas bubble dissolution and separation with drilling muds. Such a determination may allow for a transient analysis of the gas flow pattern and velocity, total free gas volume, bottomhole pressure, or any combination of these.

Further, some examples of the present disclosure can determine fluid properties of the drilling muds by accounting for fluid dynamics and phase kinetics contributing to the state of the drilling muds in the wellbore. This can provide more realistic results than, for example, relying solely on hydrostatic pressures to determine an amount of force exerted on a body of fluid at rest, since this type of equilibrium-based calculation will not accurately reflect the bottomhole pressure alone because such a calculation does not account for backpressures held at the surface, the circulation and flow rates (pump rates) of various fluids within the wellbore, or seepage of gases and fluids through permeable ingress and egress points throughout the wellbore.

Illustrative examples are given to introduce the reader to the general subject matter discussed here and are not intended to limit the scope of the disclosed concepts. The following sections described various additional features and examples with reference to the drawings in which like numerals indicate like elements, and directional descriptions are used to described the illustrative aspects, but, like the illustrative aspects, should not be used to limit the present disclosure.

FIG. 1 shows a cross-sectional view of an example of a well system 100 according to some aspects. The well system 100 includes a wellbore 108 extending through various earth strata of subterranean formation 104 beneath the well surface 102. The wellbore 108 is at least partially drilled and completed in this example, and includes a casing string 112 cemented within the wellbore 108 that extends from the well surface 102 through at least a portion of the drilled subterranean formation 104. The casing string 112 can provide a conduit through which produced formation fluids (e.g., production fluids) can travel from downhole to the well surface 102. The well system 100 is illustrated by way of example as an onshore well system, although the disclosure is equally applicable to wells formed offshore.

The casing string 112 can be held in place by casing shoes or guide shoes. In some examples, the casing string 112 may be a steel pipe, or other suitable material, placed within the wellbore 108 to prevent the walls of the subterranean bore hole from caving in. The casing string 112 may also be used to control the movement of fluids within the wellbore 108 from one formation to another.

The wellbore 108 includes a drill pipe 114, which is obscured from view in the upper half of FIG. 1 by the casing string 112. The drill pipe 114 includes a drill bit 122 for drilling through an open hole portion 116 of the wellbore 108. The drill pipe 114 rotates a drill bit 122, circulating fluids present within the wellbore 108. The drill pipe 114 may be a heavy tubing and may have multiple joints, and the drill pipe 114 is coupled to drill collar 120. Drill collar 120 attaches the drill pipe 114 to the drill bit 122, maintaining the trajectory of drill bit 122 and guiding the drilling operation. Typically, the drill collar 120 may be steel, or another heavy material, forming a thick, walled tube that stiffens the drilling system by applying pressure to the drill bit 122.

Drilling mud is a type of drilling fluid that can be specially compounded to circulate through a wellbore, such as wellbore 108, during rotary drilling operations. More specifically, drilling mud may be used to lift dislodged rock fragments out of the wellbore 108, to cool the drill bit 122, and to counteract potential increases in downhole pressure. During the drilling process, downhole pressure can decrease when gas (or a "kick" of gas) enters the wellbore 108 from the subterranean formation 104. This gas can travel uphole toward the well surface 102 in combination with other liquids or drilling fluids used during the drilling process. The gas can be at least partially dissolved in the liquids. As the liquids travel uphole, the amount of gas dissolved therein can change due to the circulation of drilling mud or changes in pressure and temperature inside the wellbore 108.

In this example, a meter 106 is positioned adjacent to wellbore 108 for detecting drilling parameters associated with the wellbore 108. The meter 106 may, in some examples, be any of the meters discussed in greater detail with respect to FIG. 4. Meter 106 may detect pressure, temperature, gas solubility, gas flow, velocity (e.g., based on annular geometry and pump rate), or any other drilling parameters. The meter 106 can then transmit such readings to computing device 130. In some examples, the computing device 130 can receive the detected drilling parameters from the meter 106 and simulate downhole characteristics based on the detected drilling parameters, as discussed in greater detail with respect to FIGS. 5-6 below.

Figure 2:
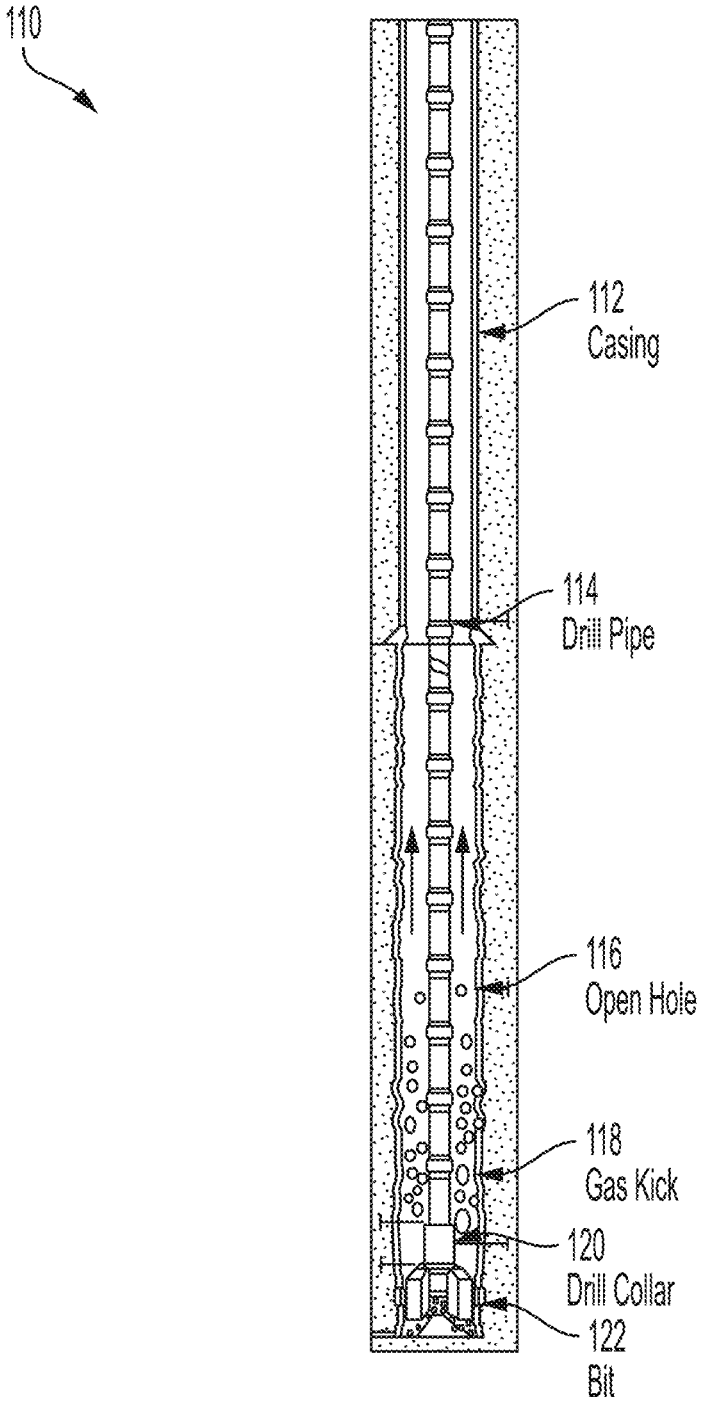
FIG. 2 is a magnified view of a portion of the wellbore shown in FIG. 1 according to some aspects of the present disclosure.

FIG. 2 is a magnified view of a portion 110 of wellbore 108 according to some aspects of the present disclosure. During drilling operations, gas bubbles may enter into wellbore 108 through a permeable surface in the open hole 116 portion of the wellbore 108 or due to a gas kick 118, causing unexpected changes in PVT. For example, gas bubbles may enter through subterranean pores, such as the open hole 116 or a subterranean pore network, formed around the wellbore 108. And during drilling operations such as MPD, typical pressures may be substantially similar to pore pressures, but some high pressure zones can cause an influx or diffusion of gas or an influx of liquids into the drilling fluid. In some examples, the gas kick 118 may be caused by the entry of water, gas, oil, or another subsurface formation drilling mud into the wellbore 108, during drilling and from permeable surroundings. Further, in some examples, the gas kick 118 may result from an amount of pressure exerted by the formation liquid being greater than the amount of pressure exerted by the column of drilling mud. If unchecked, the trapped gas kick 118 may cause a blowout.

Typically, gas can enter the wellbore from anywhere below the casing shoe, including from the open hole 116 and surrounding pore network. However, gases can also enter the wellbore at other locations, for example, due to damage to the casing string 112 during drilling operations or other wellbore operations.

Once inside the wellbore, the gas can exist in a free gas phase, remaining undissolved, for a period of time. The gas may then become at least partially dissolved in a wellbore fluid or another liquid during a wellbore operation. One example of the wellbore fluid can be an oil-base mud (e.g., an internal emulsion fluid) having dispersed water spread throughout during a drilling operation. These liquids are typically non-Newtonian liquids. A non-Newtonian fluid is a fluid that does not follow Newton's law of viscosity (i.e., constant viscosity independent of stress). A non-Newtonian fluid's response to stress (e.g., apparent viscosity) can depend on the nature of the stress, unlike Newtonian fluids that may retain a constant viscosity when stressed. As the liquid travels uphole closer to the surface, dropping pressures can result in the gas being released from the liquid phase.

Gases can have a variety of flow regimes in non-Newtonian fluids. Examples of these flow regimes can include a dispersed bubble, elongated bubble, churn flow, annular flow regime, etc. In a liquid-gas two-phase system, gas bubbles can have a variety of flow regimes within a non-Newtonian fluid contained in a channel (e.g., wellbore 108). And as the gas bubbles migrate through a channel, the gases trapped within a sidewall of the channel may transition from gas phase to a liquid phase or vice versa. In some examples, the wellbore-simulation software of the present disclosure can account for the wide variety of flow regimes of gas bubble migration in the exemplary two-phase system to yield more accurate results.

One specific example of a non-Newtonian fluid is a drilling mud. Drilling mud may have different phases, velocities, and gas volume fractions, so there can be several different flow regimes for such a two-phase system. For example, the two-phase system may have an elongated bubble, a dispersed bubble, an annular flow based on the space around a pipe in the wellbore 108, or any combination of these. Further, the flow regimes can help determine the interface area between gas and liquid, as well as regular parameters, such as pressure drop, liquid holdup, liquid cut, velocity, water resistivity, in-situ flow rate based on the original location or position in a reservoir, or any combination of these. In some examples, the system may not be limited to two phases, and instead there may be several phases associated with the transitory flow regimes.

Variations in flow regimes may be associated with different locations throughout wellbore 108. For example, the computing device 130 can divide the length of the wellbore 108 into segments. These segments may be predetermined and/or uniform in length or the segmentation may vary in length based on determined flow regimes, drilling parameters, or any of the simulation techniques discussed herein. In some examples, the length of segments may change in real-time as sensor data is reported from meter 106 or, e.g., a pressure sensor, rheometer, densitometer, or any other meter or sensor discussed herein. The computing device 130 can determine an appropriate flow regime for each segment, and use the flow regime to simulate gas bubble migration in that segment.

During a drilling operation, real-time depths and flow rates are constantly changing. For example, the flow rate of the drilling mud or gas flow in a wellbore may change based on the viscosity of drilling muds, temperature within a wellbore (e.g., wellbore 108), the amount of free gas present, or a number of other variables downhole. In order to determine the gas solubility for the changing environment of a drilling operation, some examples of the present disclosure can determine a volumetric gas dissolution coefficient. The volumetric gas dissolution coefficient k(m/s) may be defined by the equation below:

$$\left.\frac{dRs}{dt}\right|_p = -kA(Rs - Rs^*)$$

In the above equation, −k represents a measured gas dissolution constant. A represents the specific gas-liquid interface area based on clear liquid volume, e.g., a measurement of surface area of the liquid within a measured volume of the gas-liquid, which may be measured in $cm^2/cm^3$, and is a function of the combination of drilling mud and flow rate. Rs represents the calculated amount of instant gas solubility (vol/vol). And Rs* represents the amount of gas solubility in an equilibrium state. Using the above equation, the amount of gas solubility may be determined at any time step (dr) using drilling parameters, such as the interface area associated with a flow regime, pressure drop, liquid holdup, or any combination of these. Some or all of the above variables can be obtained by using the meter(s) 106 of FIG. 1 (e.g., in examples in which the wellbore-simulation software is relying at least in part on real-time data from the wellbore 108), provided as user inputs for the wellbore-simulation software, and/or by using the exemplary measuring system described in FIG. 4 below.

Figure 3:
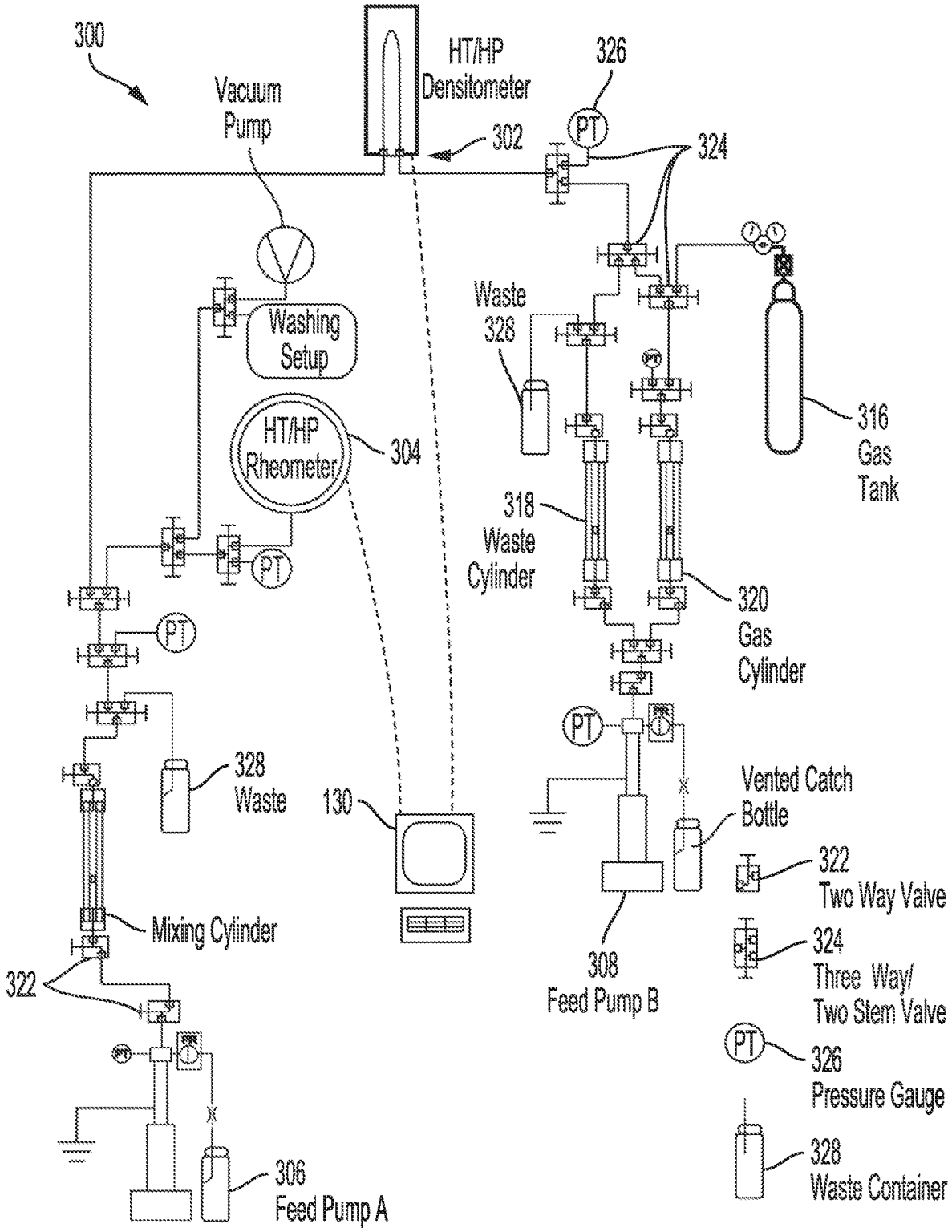
FIG. 3 is a schematic diagram of an example of a system for managing gas bubble migration according to some aspects of the present disclosure.

FIG. 3 is a schematic diagram of an example of a measuring system 300 for managing gas bubble migration according to some aspects of the present disclosure. The measuring system 300 can determine PVT measurements of gas absorption in drilling mud, including measuring and estimating a time series of gas volume and liquid volume.

The measuring system 300 is typically located above the well surface 102 and includes feed pump A 306 and feed pump B 308, which are connected to one or more wellbores 108 (not shown). The feed pumps 306 and 308, HT/HP densitometer 302, HT/HP rheometer 304, and various other components, e.g., vented catch bottle 310, gas tank 316, waste cylinder 318, gas cylinder 320, and waste container 328, are shown as being connected by a combination of two-way straight valves 322 and three-way/two-stem connection valves 324. However, in other examples, the measuring system 300 may be interconnected by any number of connection points and/or valve types, e.g., an angle valve, back pressure valve, ball valve, block valve, bevel gear operated valve, crown valve, butterfly valve, safety valve, globe valve, gate valve, wing valve, plug valve, standing valve, or any other suitable valve.

In this example, the measuring system 300 communicates the measurements obtained for the gas absorption in drilling mud to computing device 130, which may perform implicit calculations related to PVT, update velocities, determine an amount of mass transfer from gas phase to liquid phase, determine a flow regime, update a gas volume fraction, and/or update a previously determined flow regime. Specifically, the measuring system 300 obtains measurements from pressure gauges 326, HT/HP (High Temperature/High Pressure) densitometer 302 and HT/HP rheometer 304, which perform measurements similar to meter 106 discussed with respect to FIG. 1. In some examples, HT/HP can be a specific temperature and pressure range associated with wellbore 108, e.g., HP can be 10,000-15,000 psi (pounds per square inch) and HT can be 300° F.-350° F. or 150° C.-175° C.

In some examples, the densitometer 302 may be used to measure the density of drilling muds. The density of the drilling muds can be used to monitor mixtures of gases within the drilling mud. In some examples, a densitometer may be attached to a pump during production of hydrocarbon, ensuring the mixture of hydrocarbons maintain an adequate density to avoid a blowout during production. Further, the densitometer may be used to control the mixture of production or, in the event of a kick, the densitometer may control the mixture of drilling mud during a kick in, shut in, or kill event as discussed in greater detail herein.

In some examples, the rheometer 304 may be used to measure rheological properties associated with viscous materials of the wellbore production by determining an amount of elasticity, plasticity, or viscosity associated with the deformation of matter contained in the drilling mud. In some examples, the rheometer may determine such properties using Bingham plastic fluid parameters, Herschel-Bulkley parameters, a Brookfield viscosimeter, or any other suitable modeling technique to measure flow-related properties or parameters of the drilling mud. In some examples, the computing device 130 may utilize or determine initial conditions related to an identified non-Newtonian, multiphase flow regime based on measurements obtained from a rheometer, in order to update drilling parameters or perform the main function described herein.

The amount of gas solubility, Rs discussed above, can be determined by the computing device 130 based on volume difference of the free gas. For example, Rs can be determined by the computing device 130 based on the use of additional measurements provided as user input and/or obtained by measuring system 300. Examples of these additional measurements can include the real-time depth of a wellbore (e.g., the wellbore 108), the flow rate associated with a wellbore fluid influx during drilling, a geometry associated with the wellbore 108, the drill trajectory, and other drilling parameters. Examples of these other drilling parameters can include plastic drilling mud parameters, plastic viscosity, yield point, or any combination of these. In some examples, the drilling parameters may be predetermined, input by a user, estimated, or be derived from historical data. Further, the amount of free gas volume and liquid volume may be measured over time, in a series of timed intervals or time steps.

Figure 4:
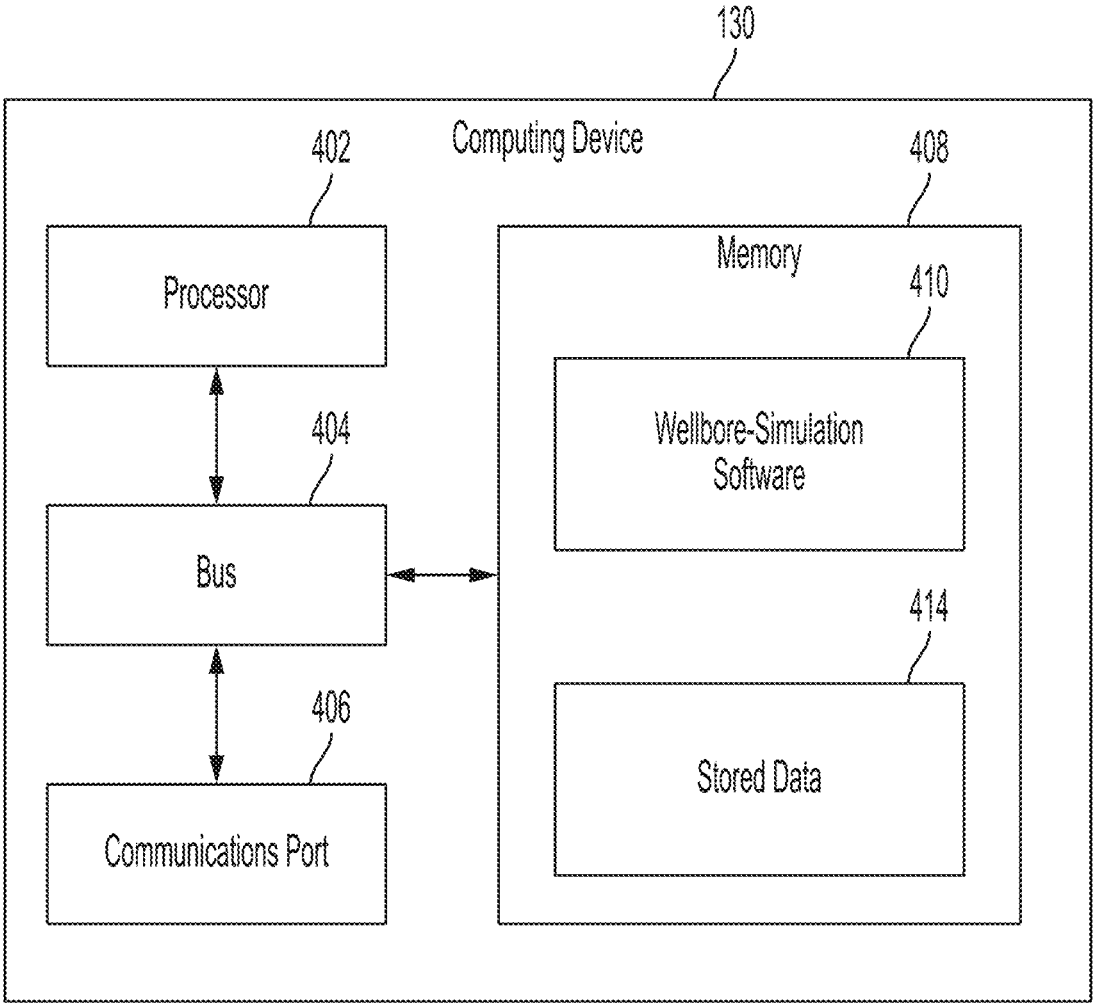
FIG. 4 is a block diagram of a computing device according to some aspects of the present disclosure.

FIG. 4 is a block diagram of a computing device 130 according to some aspects of the present disclosure. The computing device 130 includes a processor 402. The processor 402 can execute one or more operations for implementing some examples of the present disclosure. The processor 402 can execute instructions stored in a memory 408 to perform the operations. The processor 402 can include one processing device or multiple processing devices. Non-limiting examples of the processor 402 include a Field-Programmable Gate Array ("FPGA"), an application-specific integrated circuit ("ASIC"), a microprocessor, etc.

The processor 402 can be communicatively coupled to the memory 408 via a bus 404. The non-volatile memory 408 may include any type of memory device that retains stored information when powered off. Non-limiting examples of the memory 408 include electrically erasable and programmable read-only memory ("EEPROM"), flash memory, or any other type of non-volatile memory. In some examples, at least some of the memory 408 can include a medium from which the processor 402 can read instructions. A computer-readable medium can include electronic, optical, magnetic, or other storage devices capable of providing the processor 402 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The communications port 406 can be used to communicate with the external systems or devices, such as the meter 106 of FIG. 1 (e.g., which may or may not include the rheometer and densitometer of FIG. 3) or any wellbore meter associated with drilling parameters discussed herein. Gas-measurement data received by the communications port 406 can be transmitted to the memory 408 via the bus 404. The memory 408 can store any received gas-measurement data as stored data 414 for implementing some examples.

The memory 408 can include program code for wellbore-simulation software 410 that can be executed for causing the computing device 130 to perform operations according to various examples of the present disclosure, such as the operations discussed in greater detail below with respect to FIG. 5.

Figure 5:
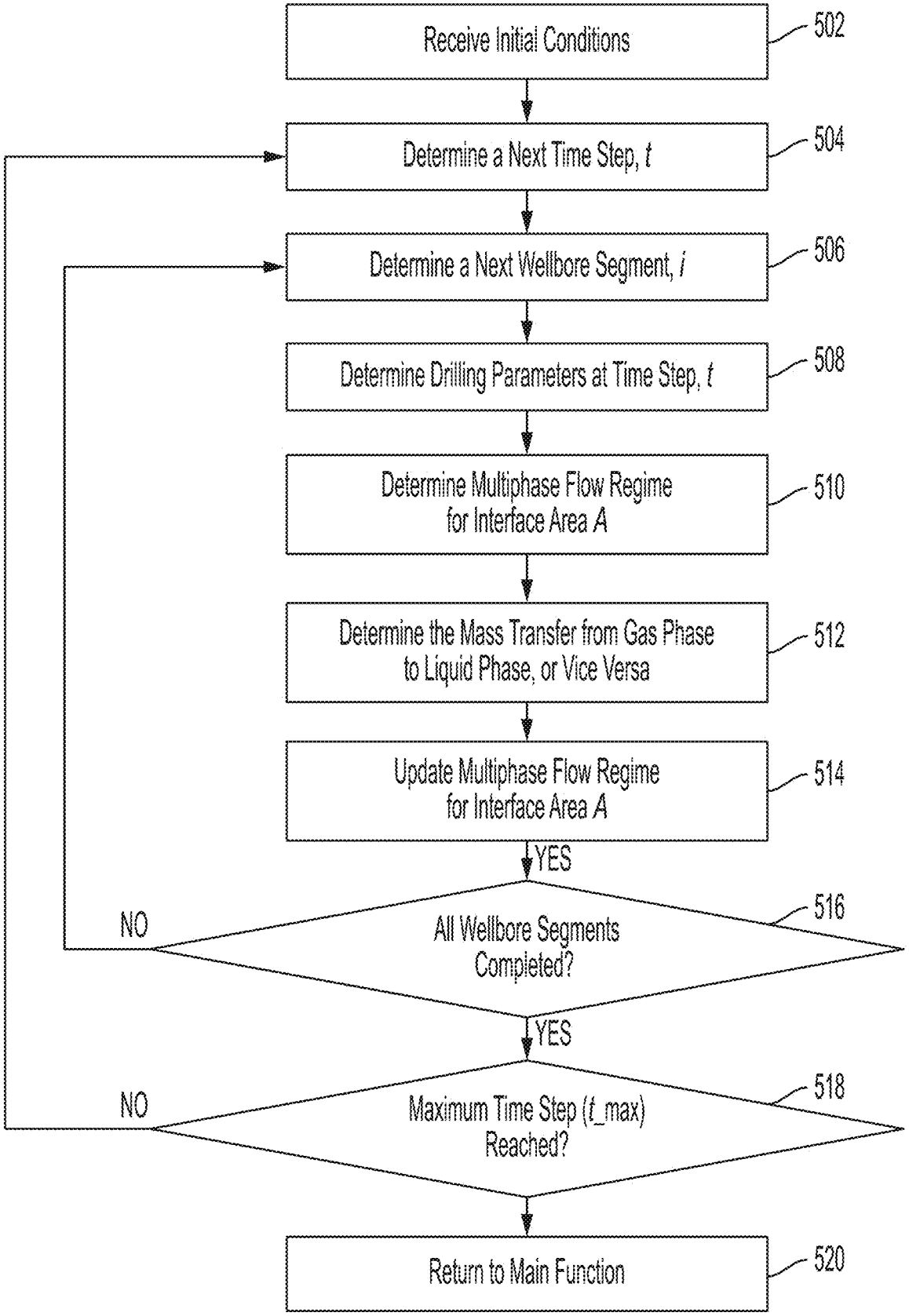
FIG. 5 is a flow chart of a process for determining gas bubble migration according to some aspects of the present disclosure.

FIG. 5 is a flow chart of a process for determining gas bubble migration according to some aspects of the present disclosure. Other examples can include more steps, fewer steps, different steps, or a different order of the steps than is shown in FIG. 5. The steps of FIG. 5 are discussed below with reference to the components discussed above in relation to FIG. 4.

In the following example, the process is part of a gas-kick simulation for illustrative purposes. But the process may also be used in the context of other wellbore simulations, such as simulations of kick in, shut in, kill procedures, or in MPD.

In block 502, a computing device 130 receives initial conditions for the simulation. Such initial conditions may obtained as part of a main function discussed herein. Examples of the initial conditions can include a wellbore geometry, wellbore trajectory, drilling mud parameters, or any combination of these. The initial conditions can be the starting conditions for the simulation.

In block 504, the computing device 130 determines a next time step, t, for the simulation. If the next time step is the first time step, the computing device 130 can associate the initial conditions with the time step. In some examples, the time step t is of predetermined length (e.g., 10 seconds). In other examples, the length of the time step t may be selected based on updated or real-time drilling parameters such as pump rate, trajectory, gas solubility, or a desired drill rate (e.g., Rate of Penetration). Such drilling parameters can be updated based on the simulation software or measurements received by a downhole sensor.

In block 506, the computing device 130 determines a next wellbore segment, i, for the simulation. For example, the computing device 130 can divide the wellbore into multiple segments between a downhole location and the well surface. In some examples, the wellbore segments can each span a fixed, predetermined, or otherwise uniform interval of wellbore. Alternatively, the wellbore segments can span non-uniform intervals of the wellbore. The intervals may be determined based on a distance within the wellbore associated with one or more of flow regimes, drilling parameters, real-time sensor data, etc.

In block 508, the computing device 130 determines drilling parameters at time step t for the wellbore segment i. If time step t is the first time step, the computing device 130 implicitly determines initial PVT calculations based on the initial conditions. Additionally, if the wellbore segment is the first wellbore segment, the computing device 130 implicitly determines initial PVT calculations based on the initial conditions for the wellbore segment i. For example, the computing device 130 can determine initial values for pressure, temperature, liquid and gas flow rates, pipe eccentricity, or any combination of these.

Next, in block 510, the computing device 130 determines a multiphase flow regime for interface area A of gas bubbles within liquid positioned in the wellbore segment i. For example, the computing device 130 identifies an interface area A between gas bubbles and a liquid in wellbore segment i and determines a multiphase flow regime based on the interface area. The multiphase flow regime may be determined based on drilling parameters related to the movement of non-Newtonian liquids, within the wellbore, which may include several different immiscible fluids, e.g., oil, water, gas, or any other liquids that are incapable of forming molecular mixtures or homogeneity. The computing device 130 can identify the interface area A based on current flow rate, gas volume, etc.

The multiphase flow regime can be associated with the various gas bubble shapes flowing uphole within the wellbore 108. For each type of multiphase flow regime, the amount of surface area of the gas bubble is constantly in a state of flux as the gas dissolves in the drilling mud and vice versa. In some examples, the variable size of the bubbles within the multiphase flow regime can be more accurately determined to simulate the gas solubility based on the dissolution of gas bubbles having a specified size and number or the rate of their dissolution.

In block 512, the computing device 130 can determine the mass transfer from gas to liquid phase, or vice versa, occurring in the wellbore segment i. For example, the computing device 130 can determine the amount of mass transfer from gas phase to liquid phase by determining the changes over time associated with the multiphase flow regime and the specific gas-liquid interface area A.

Then, the real-time gas solubility Rs can be determined for wellbore segment i using the equation discussed above in relation to FIG. 3, for example based on liquid and gas flow rates, gas solubility in the upstream point $Rs_{(i-1)}$, the equilibrium state solubility Rs* at that pressure and temperature, time step size $d_t$, and the gas dissolution constant k.

In block 514, the computing device 130 can update the multiphase flow regime for interface area A in the wellbore segment i. For example, the computing device 130 can employ an updated gas-volume fraction to re-calculate the multiphase flow regime based on the determination made in block 510. In some examples, the multiphase flow regime can be re-calculated based on the amount of mass transfer determined in block 512.

In some examples, blocks 508-514 are repeated until a gas kick solution is converged for wellbore segment i. For example, the calculations may be repeated until a kick in, shut in, kill procedure, an amount of or density of kill-weight mud (mud with a density such that its hydrostatic pressure matches or exceeds the formation pressure) can be determined, or a choke gas control, etc., is converged for wellbore segment i.

In block 516, the computing device 130 determines if the above process has been applied to all of the wellbore segments. For example, the computing device 130 can perform the determinations described above for all wellbore segments based on the segmentation discussed above, throughout wellbore 108, which are looped in that the process determines whether the total measured depth of wellbore 108 is reached.

If the computing device 130 determines that all wellbore segments have not been completed, the process returns to block 506 where blocks 506-514 are repeated. Conversely, if the computing device 130 determines that all wellbore segments have been accounted for at time step t, then the simulation can move to the next time step (e.g., t+1).

In block 518, the computing device 130 determines if the maximum time step (t_max) has been reached. For example, computing device 130 can determine whether the current time step, t, is equal to a maximum time step, t_max. If not, then the process can return to block 504 and repeat blocks 504-516. Otherwise, the process can proceed to block 520, where the computing device 130 returns to the main function.

In some examples, the wellbore-simulation software 410 can implement the above process to help well operators determine the need for kick in, shut in, kill procedures, etc. In some examples, when the computing device 130 determines that one such process is required based on a convergence of the wellbore-simulation software 410, the computing device may display a graphical user interface (GUI) having a warning, plot, graph or other notification signal.

In some examples, the computing device 130 may provide one or more recommendations to the user based on results of the wellbore simulation. For example, the computing device 130 may determine that a kill procedure would stabilize conditions downhole, based on a lookup table or other predefined relationships between simulation results and recommendations, which may be input by a wellbore operator or preprogrammed by a developer of the wellbore-simulation software. In other examples, the computing device 130 may provide recommendations based on the surface equipment layout and capabilities, to aid in the management of flow rate and pressure throughout the equipment. Such recommendations may mitigate hazards at the surface by maintaining a desired flow rate within a mud-gas separator capacity.

In some examples, the computing device 130 may generate a display based on the results of the wellbore simulation (e.g., based on the gas dissolution in the liquid over the time steps). For example, the computing device 130 may display a recommendations based on the wellbore simulation. The recommendations can include a recommendation to perform such a kill procedure in a GUI. A user that is monitoring the warnings, plots, graphs, or notifications can then implement a kill procedure by entering such a command through the GUI, e.g., changing the pump or choke gas controls, adding kill-weight mud, adding material (e.g., a kill pill) having a higher density than the mud, or any of the techniques discussed herein. In some examples, the recommendations may notify the user of an automated gas-control operation performed automatically by the computing device 130. The computing device 130 may additionally, or alternatively, cause an audio signal to be output to notify the need for an adjustment to a gas control. The computing device 130 may generate a display based on the wellbore simulation using in any number of techniques, such as through visual displays; audible, textual, or numerical alerts; messaging applications; automated voice messages; or any combination of these.

In some examples, the computing device 130 can take automated action based on outputs from the wellbore-simulation software 410. For example, the computing device 130 may transmit a control signal to a well component (e.g., a pump or blowout preventer) that controls production or a gas control. In one such example, the computing device 130 may operate a pump to maintain pressure downhole, such as by removing kick fluid in a controlled manner, circulating the kick out. Further, the simulation may identify a change in surface mud weight that should be implemented in order to eliminate an influx of wellbore liquids, or, in some cases, to control the mud density throughout the wellbore 108. In some examples, a kick in event may cause a high-pressure gas to be injected into a formation to maintain or restore reservoir pressure to a predetermined amount. As another example, the computing device 130 can employ the wellbore-simulation software 410 to fully automate operations, e.g., by machine learning techniques, of well components to cause a specific amount and/or type of mud to be pumped downhole to slow the uphole migration of gas bubbles, such as those resulting from a gas kick. In addition to the gas controls discussed above, the computing device 130 can automatically implement a kill procedure, which can cause production to cease completely, in order to recondition the well or to increase the weight of the mud downhole in the wellbore 108. Such a kill procedure may increase the density of the drilling mud within the wellbore 108, e.g., by determining an amount of kill-weight mud needed.

Figure 6:
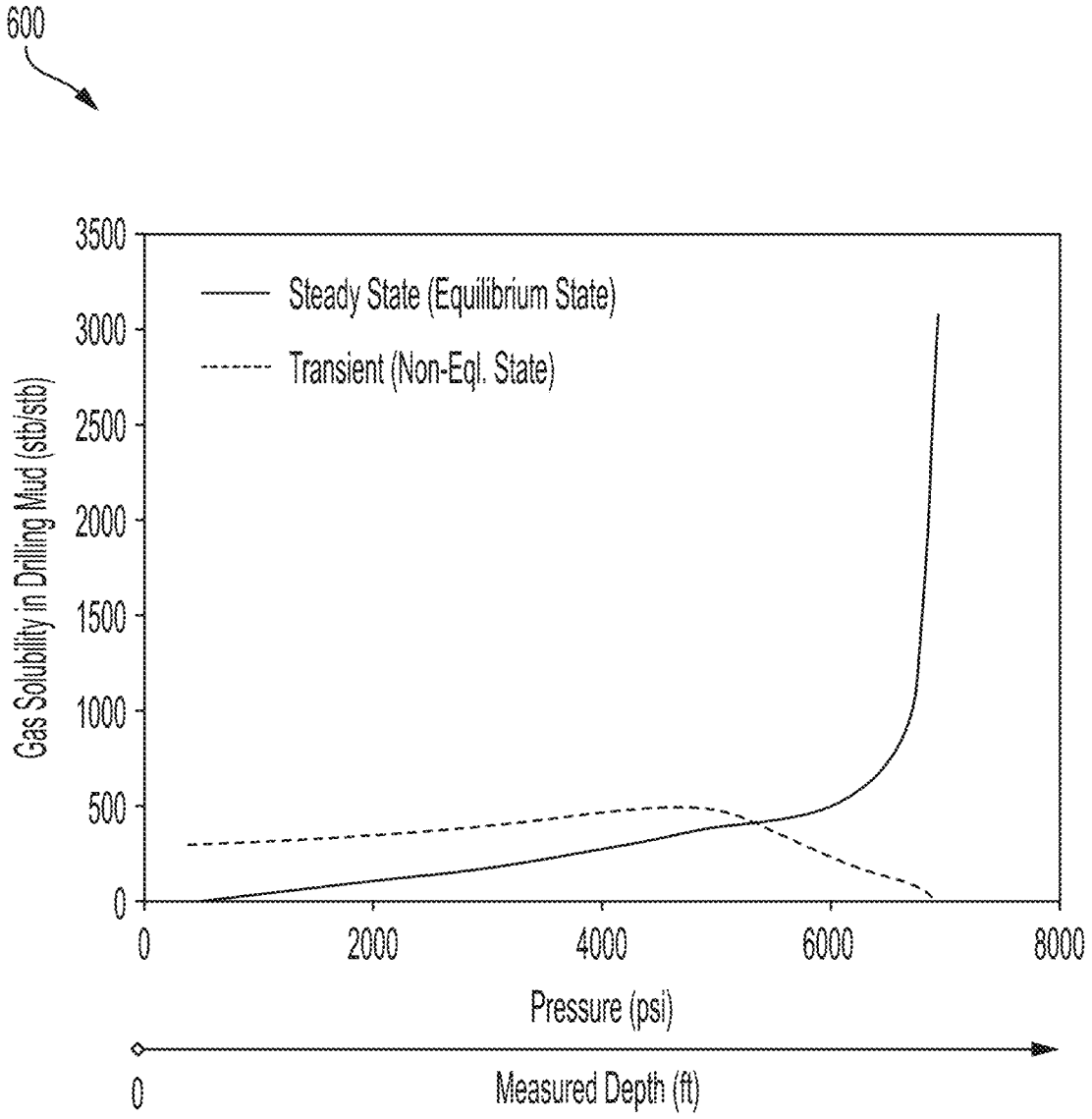
FIG. 6 is a graph depicting an example of differences between gas solubility in drilling mud during an equilibrium state and a non-equilibrium state according to some aspects of the present disclosure.

Results of the above process described in relation to FIG. 5 can differ dramatically from those obtained using traditional simulation software. FIG. 6 is a graph 600 depicting an example of such differences—more specifically, differences between gas solubility in drilling mud obtained assuming an equilibrium state (the solid line) and gas solubility in drilling mud obtained assuming non-equilibrium conditions (the dashed line), according to some aspects of the present disclosure. More specifically, the solid line is the methane solubility measured in steady state as a function of pressure at a given temperature. The dash line is a more realistic measure of the solubility distribution along the measured depth, which can be mapped to a pressure range.

Figure 7:
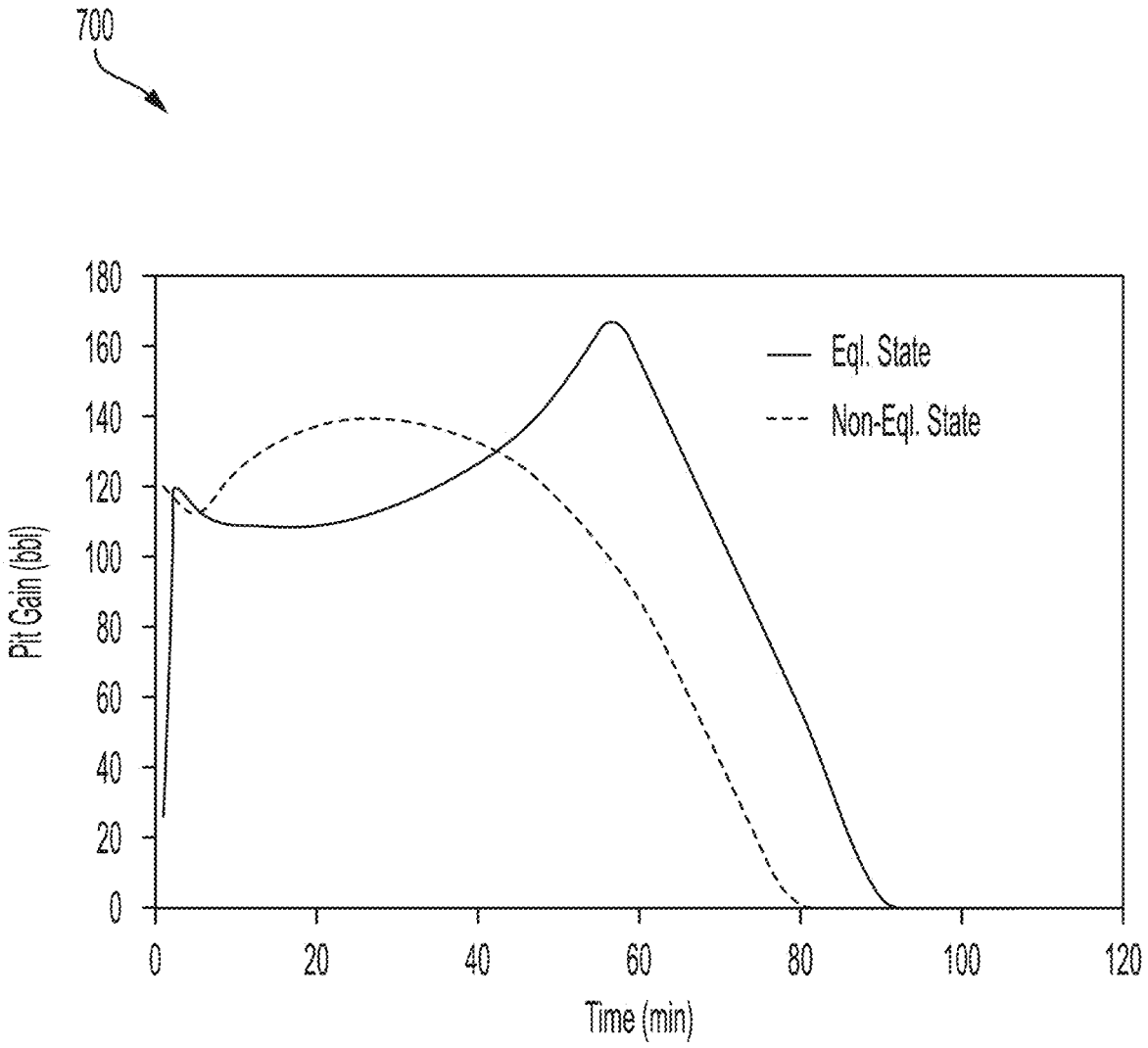
FIG. 7 is a graph depicting an example of surface pit gain according to some aspects.

FIG. 7 is a graph 700 depicting an example of surface pit-gain according to some aspects. At the lower part of a wellbore (e.g., wellbore 108) where pressure is high, the formation gas enters the wellbore 108; the gas concentration in the liquid phase starts to increase from zero. At this point, e.g. p=7000 psi, from the equilibrium state measurement, gases are dissolved into liquid, but in reality, gases can remain in bubble phase for a certain distance or time until being fulling dissolved. So from the right side of the plot, the dash line curve is much lower than the solid one. At this point, if gases are treated with equilibrium state solubility, all gas can be dissolved in all portions; the volume change can be small, resulting a small increase for the surface pit-gain, shown in the solid curve in FIG. 7.

When gases migrate to the upper location closer to the surface, the pressure can be lower and gases start to separate from the liquid. Also, due to the mass transfer rate, gases cannot be released immediately. Equilibrium state solubility gives an underestimated value of Rs and predicts a relative higher free gas volume and thus higher surface pit-gain. In non-equilibrium solubility cases, most of the gas can remain dissolved in liquid, although the pressure is lower. Surface pit-gain can be less than predicted by steady-state analysis. In some examples, the amount of surface pit-gain can be measured by a sensor, allowing the wellbore-simulation software 410 to update initial conditions to produce a more accurate simulation.

By using certain examples of the present disclosure, non-equilibrium gas bubble dissolution and separation rate with drilling muds can be calculated for a transient analysis in a gas bubble migration process, and used in a variety contexts to improve performance and prevent damage to wellbore components.

In some aspects, gas bubble migration in a downhole liquid can be managed according to one or more of the following examples:

Example #1: A system can include a processing device and a memory device including wellbore-simulation software that is executable by the processing device. The wellbore-simulation software can cause the processing device to simulate changes in gas dissolution in a liquid flowing from a downhole location through a wellbore to a well surface over the course of a plurality of time steps by: dividing the wellbore into a plurality of segments spanning from the well surface to the downhole location, each segment spanning a respective depth increment between the well surface and the downhole location; and for each time step of the plurality of time steps: determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment. The wellbore-simulation software can also cause the processing device to generate a display based on the changes in the gas dissolution in the liquid over the plurality of time steps.

Example #2: The system of Example #1 may feature the wellbore-simulation software being executable by the processing device for causing the processing device to determine how much of the gas is dissolved in the liquid at each segment of the plurality of segments based on a gas-liquid interface area at the segment, a gas solubility level at the segment, and an equilibrium-state gas solubility at the segment.

Example #3: The system of Example #2 may feature the wellbore-simulation software being executable by the processing device for causing the processing device to determine the gas-liquid interface area at the segment based on the respective multiphase-flow regime at the segment.

Example #4: The system of any of Examples #2-3 may feature the wellbore-simulation software being executable by the processing device for causing the processing device to determine the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

Example #5: The system of any of Examples #1-4 may feature the wellbore-simulation software being executable by the processing device for causing the processing device to output a danger warning based on the gas dissolution in the liquid satisfying at least one predefined criterion during the plurality of time steps.

Example #6: The system of any of Examples #1-5 may feature the wellbore-simulation software being executable by the processing device for causing the processing device to output a notification indicating a recommended well activity depending on the gas dissolution in the liquid over the plurality of time steps. The recommended well activity can be a gas control activity. The gas control activity can include a kick in event, a shut in event, or a kill procedure associated with the wellbore.

Example #7: The system of any of Examples #1-6 may feature the wellbore-simulation software being executable by the processing device for causing the processing device to automate a gas control based on a determination of an influx of gas. The gas control can be configured to cause an increase in mud density or a change in pump rate.

Example #8: A method can include simulating changes in gas dissolution in a liquid flowing from a downhole location through a wellbore to a well surface over the course of a plurality of time steps by: dividing the wellbore into a plurality of segments spanning from the well surface to the downhole location, each segment spanning a respective depth increment between the well surface and the downhole location; and for each time step of the plurality of time steps: determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment. The method can also include generating a display based on the changes in the gas dissolution in the liquid over the plurality of time steps. Some or all of the method steps can be implemented by a processing device executing wellbore-simulation software.

Example #9: The method of Example #8 may involve determining how much of the gas is dissolved in the liquid at each segment of the plurality of segments based on a gas-liquid interface area at the segment, a gas solubility level at the segment, and an equilibrium-state gas solubility at the segment.

Example #10: The method of Example #9 may involve determining the gas-liquid interface area at the segment based on the respective multiphase-flow regime at the segment.

Example #11: The method of any of Examples #9-10 may involve determining the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

Example #12: The method of any of Examples #8-11 may involve outputting a danger warning based on the gas dissolution in the liquid satisfying at least one predefined criterion during the plurality of time steps.

Example #13: The method of any of Examples #8-12 may involve determining outputting a notification indicating a recommended well activity depending on the gas dissolution in the liquid over the plurality of time steps. The recommended well activity can be a gas control activity. The gas control activity can include a kick in event, a shut in event, or a kill procedure associated with the wellbore.

Example #14: The method of any of Examples #8-13 may involve automating a gas control based on a determination of an influx of gas. The gas control can be configured to cause an increase in mud density or a change in pump rate.

Example #15: A non-transitory computer-readable medium that includes wellbore-simulation software that is executable by a processing device can cause the processing device to simulate changes in gas dissolution in a liquid flowing from a downhole location to a well surface through a wellbore over the course of a plurality of time steps by: dividing the wellbore into a plurality of segments spanning from the well surface to the downhole location, each segment spanning a respective depth increment between the well surface and the downhole location; and for each time step of the plurality of time steps: determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment. The wellbore-simulation software can also cause the processing device to generate a display based on the changes in the gas dissolution in the liquid over the plurality of time steps.

Example #16: The non-transitory computer-readable medium of Example #15 may feature the wellbore-simulation software being executable by the processing device for causing the processing device to determine how much of the gas is dissolved in the liquid at each segment of the plurality of segments based on a gas-liquid interface area at the segment, a gas solubility level at the segment, and an equilibrium-state gas solubility at the segment.

Example #17: The non-transitory computer-readable medium of Example #16 may feature the wellbore-simulation software being executable by the processing device for causing the processing device to determine the gas-liquid interface area at the segment based on the respective multiphase-flow regime at the segment.

Example #18: The non-transitory computer-readable medium of any of Examples #16-17 may feature the wellbore-simulation software being executable by the processing device for causing the processing device to determine the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

Example #19: The non-transitory computer-readable medium of any of Examples #15-18 may feature the wellbore-simulation software being executable by the processing device for causing the processing device to output a danger warning based on the gas dissolution in the liquid satisfying at least one predefined criterion during the plurality of time steps.

Example #20: The non-transitory computer-readable medium of any of Examples #15-19 may feature the wellbore-simulation software being executable by the processing device for causing the processing device to output a notification indicating a recommended well activity depending on the gas dissolution in the liquid over the plurality of time steps. The recommended well activity can be a gas control activity. The gas control activity can include a kick in event, a shut in event, or a kill procedure associated with the wellbore.

The foregoing description of certain embodiments, including illustrated embodiments, has been presented only for the purpose of illustration and description and is not intended to be exhaustive or to limit the disclosure to the precise forms disclosed. Numerous modifications, adaptations, combinations, and uses thereof are possible without departing from the scope of the disclosure.

The invention claimed is:

1. A system comprising:

a processing device; and a memory device including wellbore-simulation software that is executable by the processing device for causing the processing device to:

simulate changes in gas dissolution of a gas in a liquid flowing from a downhole location through a wellbore to a well surface over the course of a plurality of time steps by:

dividing the wellbore into a plurality of segments spanning from the well surface to the downhole location, each segment spanning a respective depth increment between the well surface and the downhole location; and for each time step of the plurality of time steps:

determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment; and generate a display based on the changes in the gas dissolution in the liquid over the plurality of time steps.

2. The system of claim 1, wherein the wellbore-simulation software is executable by the processing device for causing the processing device to determine how much of the gas is dissolved in the liquid at each segment of the plurality of segments based on a gas-liquid interface area at the segment, a gas solubility level at the segment, and an equilibrium-state gas solubility at the segment.

3. The system of claim 2, wherein the wellbore-simulation software is executable by the processing device for causing the processing device to determine the gas-liquid interface area at the segment based on the respective multiphase-flow regime at the segment.

4. The system of claim 3, wherein the wellbore-simulation software is executable by the processing device for causing the processing device to determine the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

5. The system of claim 1, wherein the wellbore-simulation software is executable by the processing device for causing the processing device to output a danger warning based on the gas dissolution in the liquid satisfying at least one predefined criterion during the plurality of time steps.

6. The system of claim 1, wherein the wellbore-simulation software is executable by the processing device for causing the processing device to output a notification indicating a recommended well activity depending on the gas dissolution in the liquid over the plurality of time steps, and wherein the recommended well activity is a gas control activity, and wherein the gas control activity includes a kick in event, a shut in event, or a kill procedure associated with the wellbore.

7. The system of claim 1, wherein the wellbore-simulation software is executable by the processing device for causing the processing device to automate a gas control based on a determination of an influx of gas, wherein the gas control is configured to cause an increase in mud density or a change in pump rate.

8. A method comprising:

simulating, by a processing device executing wellbore-simulation software, changes in gas dissolution of a gas in a liquid flowing from a downhole location through a wellbore to a well surface over the course of a plurality of time steps by:

dividing the wellbore into a plurality of segments spanning from the well surface to the downhole location, each segment spanning a respective depth increment between the well surface and the downhole location; and for each time step of the plurality of time steps:

determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment; and generating, by the processing device, a display based on the changes in the gas dissolution in the liquid over the plurality of time steps.

9. The method of claim 8, further comprising determining how much of the gas is dissolved in the liquid at each segment of the plurality of segments based on a gas-liquid interface area at the segment, a gas solubility level at the segment, and an equilibrium-state gas solubility at the segment.

10. The method of claim 9, further comprising determining the gas-liquid interface area at the segment based on the respective multiphase-flow regime at the segment.

11. The method of claim 10, further comprising determining the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

12. The method of claim 8, further comprising outputting a danger warning based on the gas dissolution in the liquid satisfying at least one predefined criterion during the plurality of time steps.

13. The method of claim 8, further comprising determining outputting a notification indicating a recommended well activity depending on the gas dissolution in the liquid over the plurality of time steps, and wherein the recommended well activity is a gas control activity, and wherein the gas control activity includes a kick in event, a shut in event, or a kill procedure associated with the wellbore.

14. The method of claim 8, further comprising automating a gas control based on a determination of an influx of gas, wherein the gas control is configured to cause an increase in mud density or a change in pump rate.

15. A non-transitory computer-readable medium that includes wellbore-simulation software that is executable by a processing device for causing the processing device to:

simulate changes in gas dissolution of a gas in a liquid flowing from a downhole location to a well surface through a wellbore over the course of a plurality of time steps by:

dividing the wellbore into a plurality of segments spanning from the well surface to the downhole location, each segment spanning a respective depth increment between the well surface and the downhole location; and for each time step of the plurality of time steps:

determining a respective multiphase-flow regime associated with each segment of the plurality of segments based on a simulated pressure level, a simulated temperature, a simulated pipe eccentricity, and a simulated fluid velocity at the segment; and determining how much of the gas is dissolved in the liquid at each segment of the plurality of segments based on the respective multiphase-flow regime at the segment; and generate a display based on the changes in the gas dissolution in the liquid over the plurality of time steps.

16. The non-transitory computer-readable medium of claim 15, wherein the wellbore-simulation software is executable by the processing device for causing the processing device to determine how much of the gas is dissolved in the liquid at each segment of the plurality of segments based on a gas-liquid interface area at the segment, a gas solubility level at the segment, and an equilibrium-state gas solubility at the segment.

17. The non-transitory computer-readable medium of claim 16, wherein the wellbore-simulation software is executable by the processing device for causing the processing device to determine the gas-liquid interface area at the segment based on the respective multiphase-flow regime at the segment.

18. The non-transitory computer-readable medium of claim 17, wherein the wellbore-simulation software is executable by the processing device for causing the processing device to determine the gas solubility level at the segment based on: (i) a flow rate of the gas at the segment, (ii) a flow rate of the liquid at the segment, (iii) gas solubility in an adjacent segment, (iv) the equilibrium-state gas solubility at the segment, (v) a time step size, and (vi) a gas dissolution constant.

19. The non-transitory computer-readable medium of claim 15, wherein the wellbore-simulation software is executable by the processing device for causing the processing device to output a danger warning based on the gas dissolution in the liquid satisfying at least one predefined criterion during the plurality of time steps.

20. The non-transitory computer-readable medium of claim 15, wherein the wellbore-simulation software is executable by the processing device for causing the processing device to output a notification indicating a recommended well activity depending on the gas dissolution in the liquid over the plurality of time steps, and wherein the recommended well activity is a gas control activity, and wherein the gas control activity includes a kick in event, a shut in event, or a kill procedure associated with the wellbore.

* * * * *